US006513558B1

(12) United States Patent
Chen

(10) Patent No.: US 6,513,558 B1
(45) Date of Patent: Feb. 4, 2003

(54) METHOD OF MANUFACTURING CARVED WOODEN DOORS

(75) Inventor: Wen Tsen Chen, Taipei (TW)

(73) Assignee: Cheng Ta Wood Industry, Ltd., I Lan Hsien (TW)

( * ) Notice: Subject to any disclaimer, the term of this patent is extended or adjusted under 35 U.S.C. 154(b) by 0 days.

(21) Appl. No.: 09/923,364

(22) Filed: Aug. 8, 2001

(51) Int. Cl.[7] ..... B27F 1/00

(52) U.S. Cl. ..... 144/345; 52/455; 52/457; 144/347; 144/351; 156/264; 156/265; 156/304.5

(58) Field of Search ..... 144/344, 345, 144/347, 351; 156/764, 265, 266, 304.1, 304.5; 52/455, 457

(56) References Cited

U.S. PATENT DOCUMENTS 5,135,597 A * 8/1992 Barker ..... 144/345 X 5,540,026 A * 7/1996 Gartland ..... 52/455

* cited by examiner

*Primary Examiner*—W. Donald Bray
(74) *Attorney, Agent, or Firm*—Leong C. Lei

(57) ABSTRACT

A method of manufacturing carved wooden doors includes the steps of forming wooden blocks with different width but same height and joining them together at a vertical lateral side thereof, joining said wooden blocks together to form a rectangular member for carving, carving desired patterns on said rectangular member, and carving a transverse recess on said rectangular member and affixing a panel in said transverse recess to form a complete carved wooden door, whereby carved wooden doors can be manufactured at a faster speed than the conventional and joint connections of said wooden doors can be prevented from becoming loose thereby prolonging service life thereof.

1 Claim, 7 Drawing Sheets

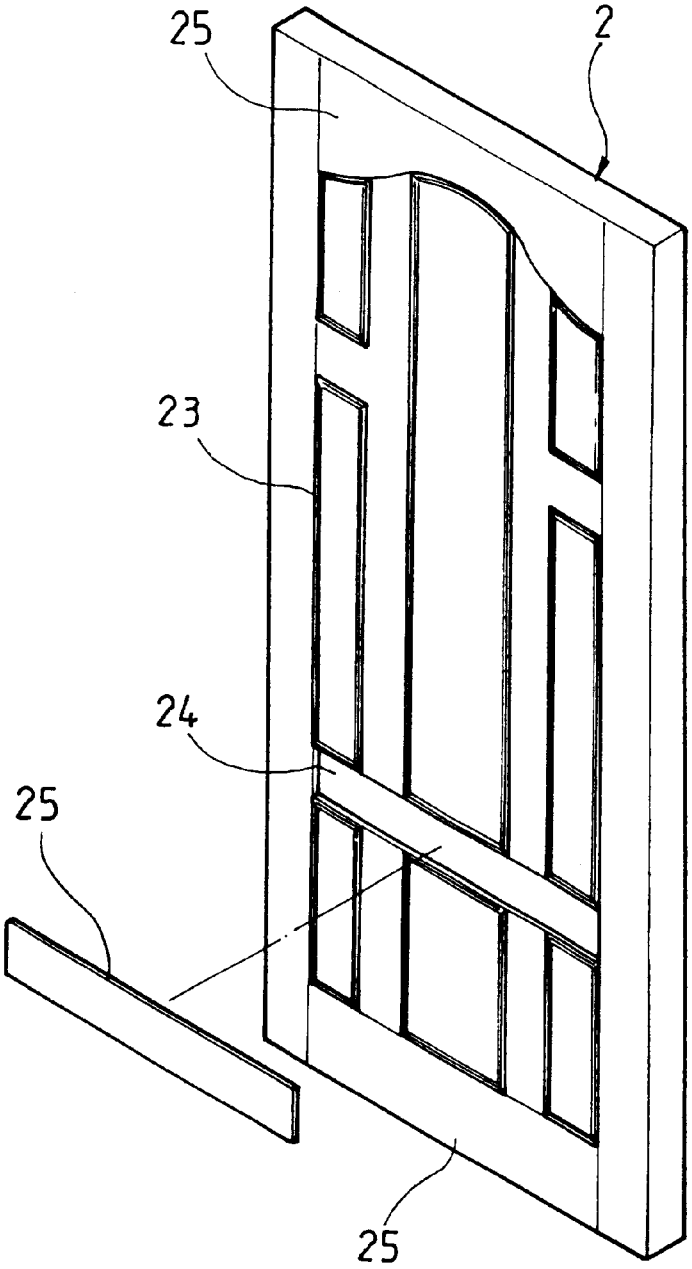
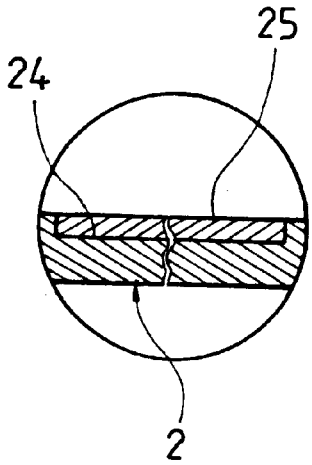
FIG. 5A
FIG. 5

METHOD OF MANUFACTURING CARVED WOODEN DOORS

BACKGROUND OF THE INVENTION

1. Field of the Invention

This invention is related to a method of manufacturing carved wooden doors and in particular to one which can produce carved wooden doors at a faster speed than the conventional and can prevent the joint connections from becoming loose thereby prolonging the service life thereof 2. Description of the Prior Art As shown in FIG. 1, the conventional method of manufacturing carved wooden doors generally includes the steps of providing vertical rails 11 and horizontal rails 12, providing rectangular panels 13 with flanges 131, providing tenons 121 on two ends of the horizontal rails 12 and mortises 112 and grooves 113 on the inner edges of the vertical rails 11, assembling the vertical rails 11, horizontal rails and rectangular panels 13 together with the tenons 121 engaged with the mortises 112 and the flanges 131 engaged with the grooves 113 thereby forming a carved wooden door 1.

However, it is necessary to form carving on the edge 132 or the surface of the rectangular panels 13 so as to provide an aesthetic appearance, but the manufacturing of such carved wooden doors is complicated thus increasing the cost. Furthermore, after a certain time period of use, the joints between the vertical rails 11, horizontal rails 12 and the rectangular panels 13 will become loose due to expansion and retraction in different seasons thus forming clearances and therefore impairing the outlook of the door.

Another conventional method of manufacturing carved wooden doors includes the steps of joining rectangular panels made of plywood with vertical and horizontal rails. However, it is necessary to stick a layer of natural solid wood on the outer sides of the rectangular panels and the vertical and horizontal rails. Anyhow, such a kind of door does not look like a carved wooden door at all.

Therefore, it is an object of the present invention to provide an improved method of manufacturing carved wooden doors which can obviate and mitigate the above-mentioned drawbacks.

SUMMARY OF THE INVENTION

This invention is related to an improved method of manufacturing carved wooden doors.

It is the primary object of the present invention to provide a method of manufacturing carved wooden doors which can produce carved wooden doors at a faster speed than the conventional and can prevent the joint connections from becoming loose thereby prolonging the service life thereof According to a preferred embodiment of the present invention, a method of manufacturing carved wooden doors includes the steps of forming wooden blocks with different width but same height and joining them together at a vertical lateral side thereof, joining said wooden blocks together to form a rectangular member for carving, carving desired patterns on said rectangular member, and carving a transverse recess on said rectangular member and affixing a panel in said transverse recess to form a complete carved wooden door.

The foregoing object and summary provide only a brief introduction to the present invention. To filly appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 5 is a perspective view of the carved wooden door according to the present invention, illustrating how a transverse panel is affixed to the door;

FIG. 5A is an enlarged sectional view of a portion of FIG. 5;

DETAILED DESCRIPTION OF THE PRESENT INVENTION

Figure 1:
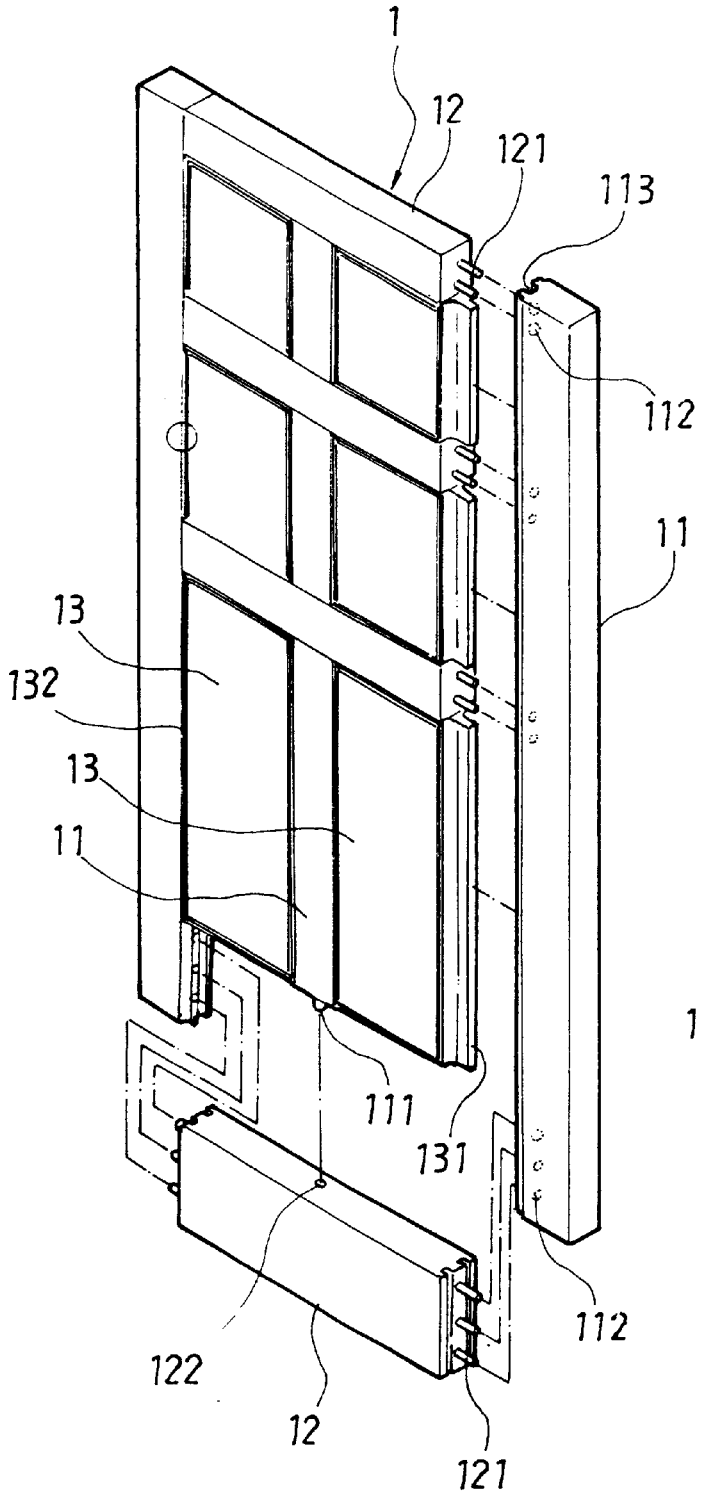
PRIOR ART FIG. 1
FIG. 1 is an exploded view of a prior art carved wooden door.
Figure 1A:
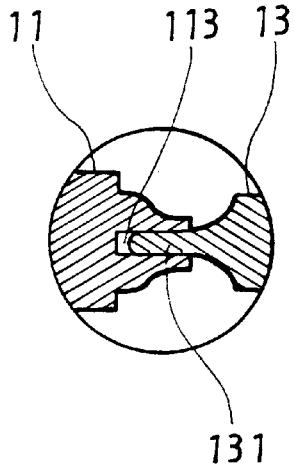
PRIOR ART FIG. 1A
FIG. 1A is enlarged fragmentary view of a portion of the prior art carved wooden door.
Figure 3:
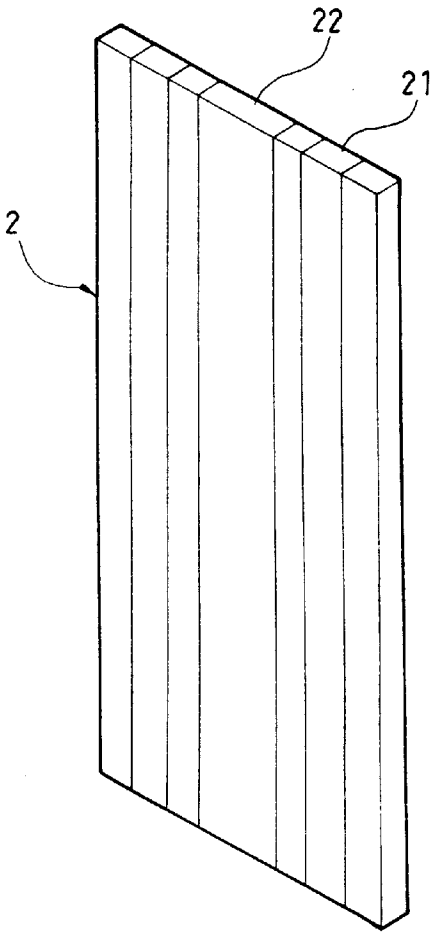
FIG. 3 is a perspective view illustrating the wooden member.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 2:
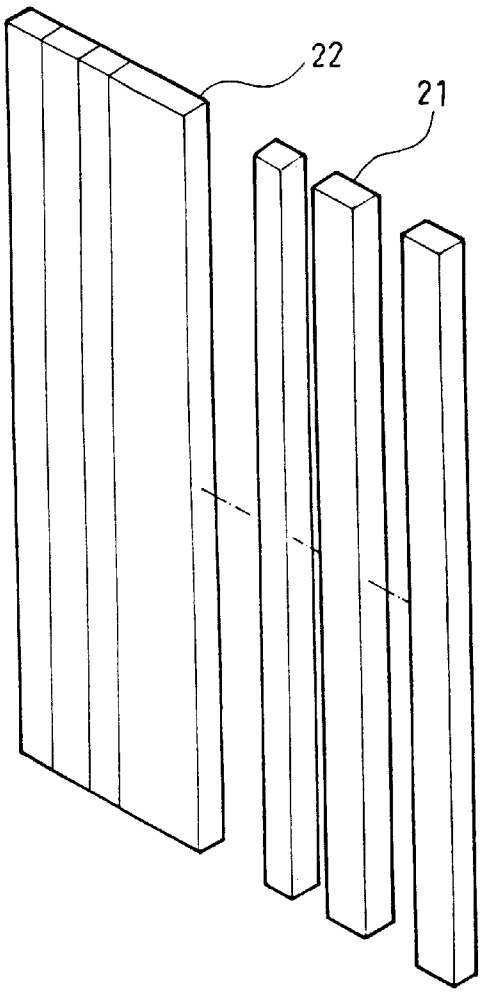
FIG. 2 is an exploded view of wooden members for manufacturing the carved wooden door according to the present invention.
Figure 4:
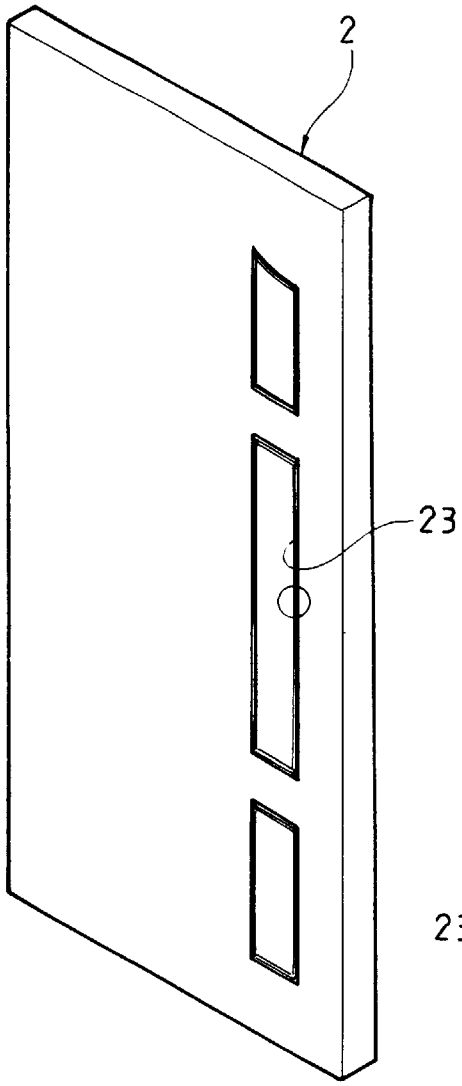
FIG. 4 is a perspective view of the carved wooden door according to the present invention.
Figure 4A:
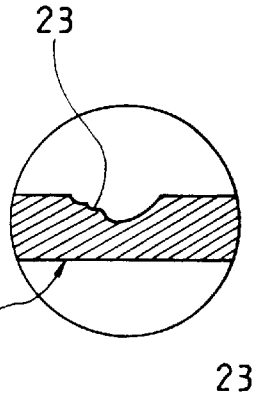
FIG. 4A is enlarged sectional view of a portion of FIG. 4.
Figure 4B:
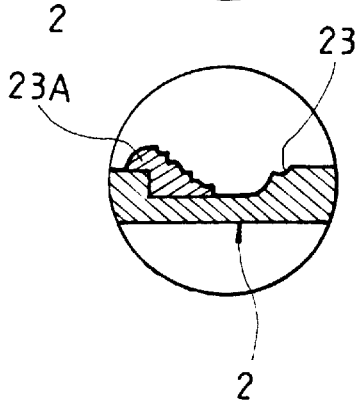
FIG. 4B is an enlarged sectional view of another preferred embodiment according to present invention.
Figure 6:
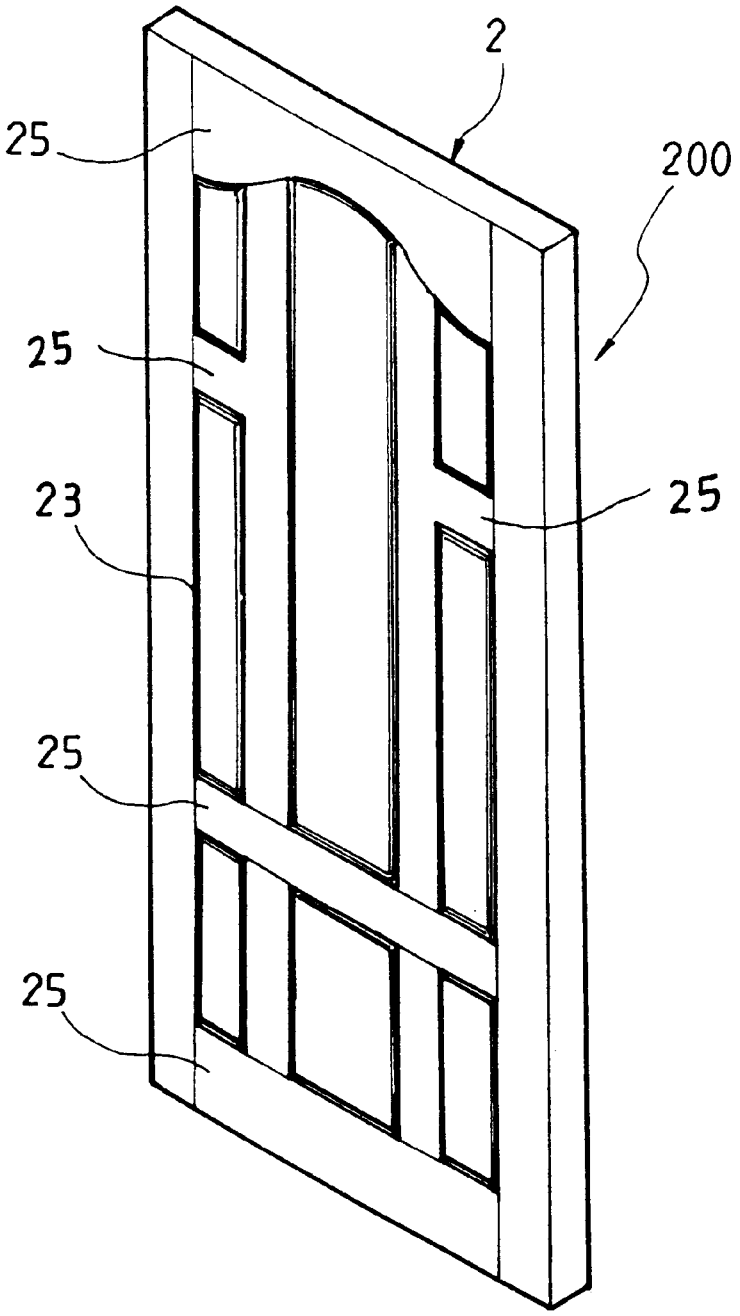
FIG. 6 is another perspective view of the carved wooden door according to the present invention.

The method of manufacturing carved wooden doors according to the present invention comprises the steps of:

1. forming wooden blocks 21 and 22 with different width but the same height and joining them together at the vertical lateral side (see FIG. 2);
2. joining the wooden blocks 21 and 22 together to form a rectangular member 2 for carving;
3. carving desired patterns 23 on the rectangular member 2 by means of computer numerical control (CNC) carving machines, or carving a recess on the rectangular member 2 first and then adhering a decorated member 23A to the recess (see FIGS. 4, 4A and 4B), wherein the pattern 23 is preferably carved on the joining line between the wooden blocks so as to make the pattern 23 look more beautiful;

4. carving a transverse recess 24 on the rectangular member 2 and affixing a panel 25 in the transverse recess 24 (see FIGS. 5 and 5A) to form a complete carved wooden door 200 (see FIG. 6).

Figure 6A:
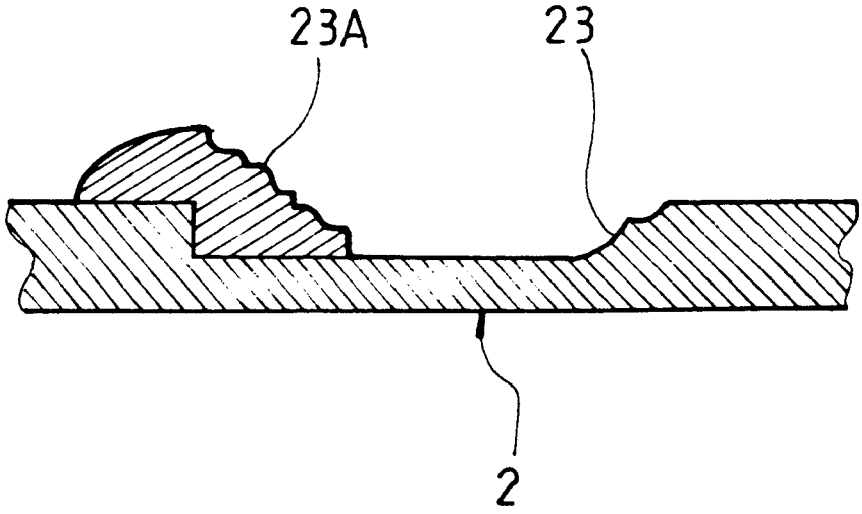
FIG. 6A is an enlarged view of FIG. 4B.
Figure 6B:
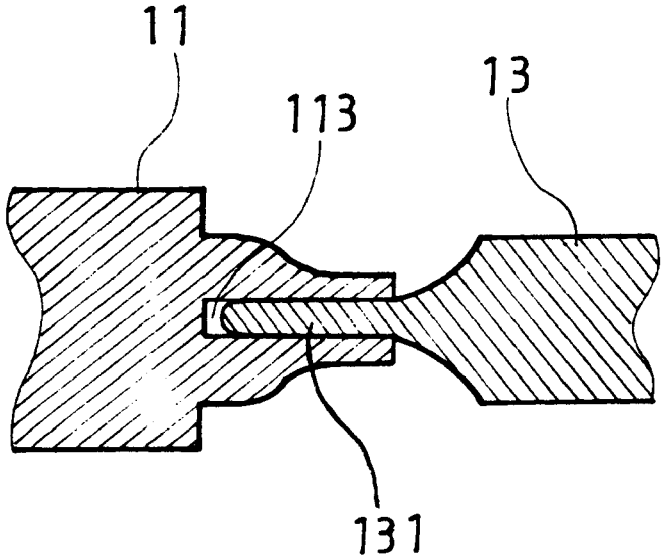
PRIOR ART FIG. 6 B
FIG. 6B is an enlarged view of FIG. 1A.

Accordingly, the rectangular member 2 can be processed into a carved wooden door 200 (see FIG. 6) which can be easily manufactured at a high efficiency. Furthermore, the decorated member 23A is affixed to the recess formed on the rectangular member 2 (see FIG. 6A), while the flange 131 of the rectangular panel 13 must be inserted into a groove 113 of the vertical rail 11 (see FIG. 6B) according to the prior art. Moreover, no tenons and mortises are required for the assembly of the present invention, so that the carved wooden door according to the present invention will have a much longer service life than that according to the prior art.

Figure 7:
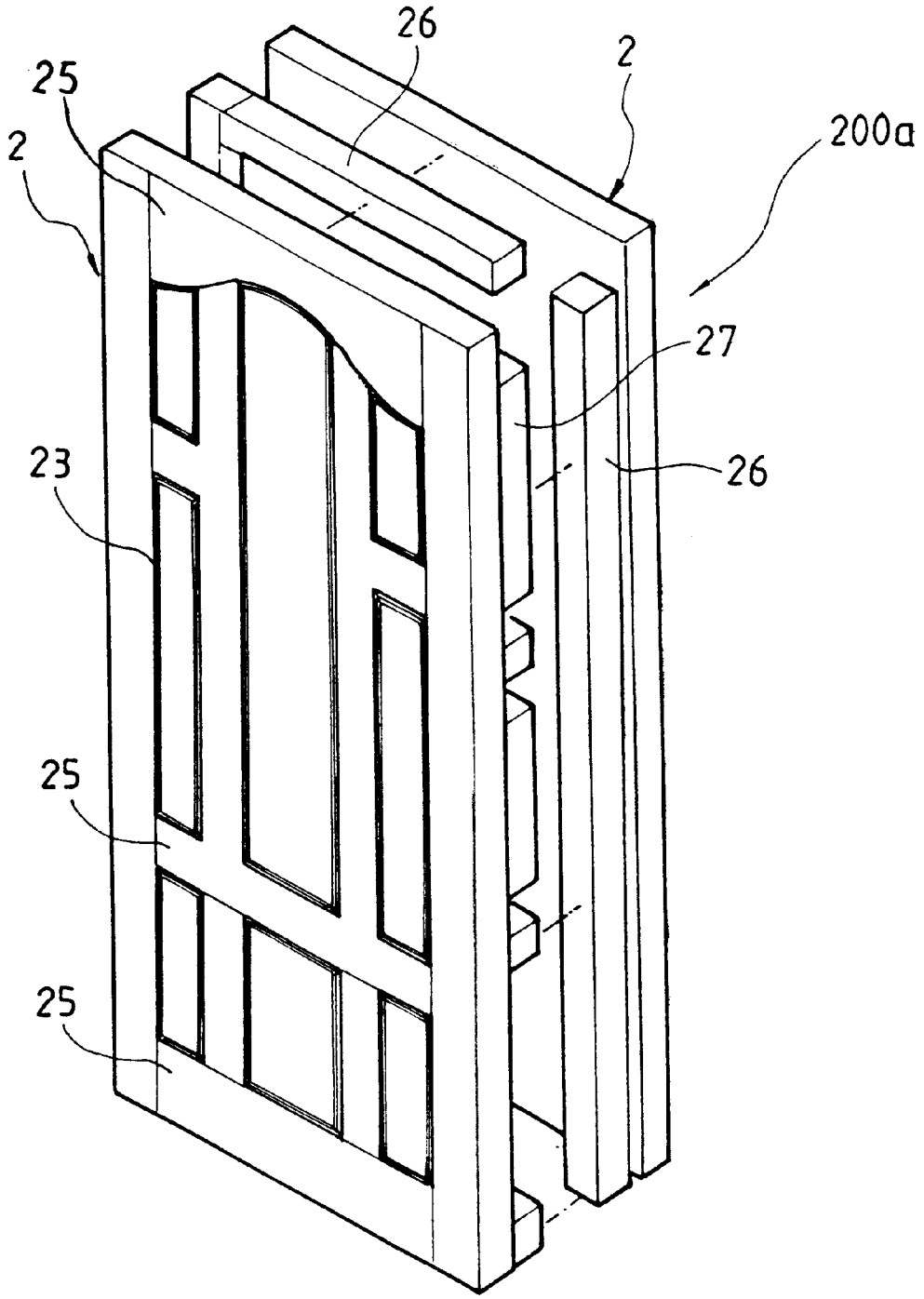
FIG. 7 illustrates another preferred embodiment of the present invention.

Referring to FIG. 7, two thin carved wooden doors 200 according to the present invention can be joined together with a frame 26 and filler 27 therebetween to form a thicker carved wooden door as required.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A method of manufacturing carved wooden doors comprising the steps of:

forming wooden blocks with different width but same height and joining said wooden blocks together at a vertical lateral side thereof;

joining said wooden blocks together to form a rectangular member;

carving a recess on said rectangular member;

adhering a decorated member to said recess; and carving a transverse recess on said rectangular member and affixing a panel in said transverse recess to form a complete carved wooden door.

* * * * *